United States Patent [19]

Eby

[11] 3,962,806

[45] June 15, 1976

[54] ROTATING MESSAGE DEVICE

[75] Inventor: Devon L. Eby, Nappanee, Ind.

[73] Assignee: Tyme and Tydings Inc., Nappanee, Ind.

[22] Filed: Dec. 26, 1974

[21] Appl. No.: 536,417

[52] U.S. Cl. ..... 40/33; 40/77

[51] Int. Cl.[2] ..... G09F 11/23

[58] Field of Search ..... 40/33, 77, 106.53, 128, 40/131 R

[56] References Cited

UNITED STATES PATENTS

| | | | |
|---|---|---|---|
| 1,930,048 | 10/1933 | Harding et al. | 40/33 |
| 2,863,237 | 12/1958 | Matthews | 40/33 X |
| 3,031,784 | 5/1962 | Stein | 40/33 X |
| 3,105,315 | 10/1963 | Snethen | 40/77 |
| 3,201,881 | 8/1965 | Dechar | 40/33 X |
| 3,345,766 | 10/1967 | Timlin | 40/77 |
| 3,701,897 | 10/1972 | Pennington et al. | 40/33 X |

*Primary Examiner*—Louis G. Mancene
*Assistant Examiner*—John F. Pitrelli
*Attorney, Agent, or Firm*—Hobbs & Green

[57] ABSTRACT

A rotating message device having upper and lower plates, a plurality of side panels forming a body with a hollow interior and a drive motor disposed in the hollow interior and connected to a supporting structure by arms extending upwardly through the top plate. At least some of the panels are partially transparent and a light means is disposed in the hollow interior to light up the transparent panels. The panels are replaceably held in vertical position along the sides by posts interconnecting the upper and lower plates and by flexible strips placed in front of the posts, thus permitting the panels to be inserted and removed whenever messages or signs are to be changed.

5 Claims, 5 Drawing Figures

Fig. 4
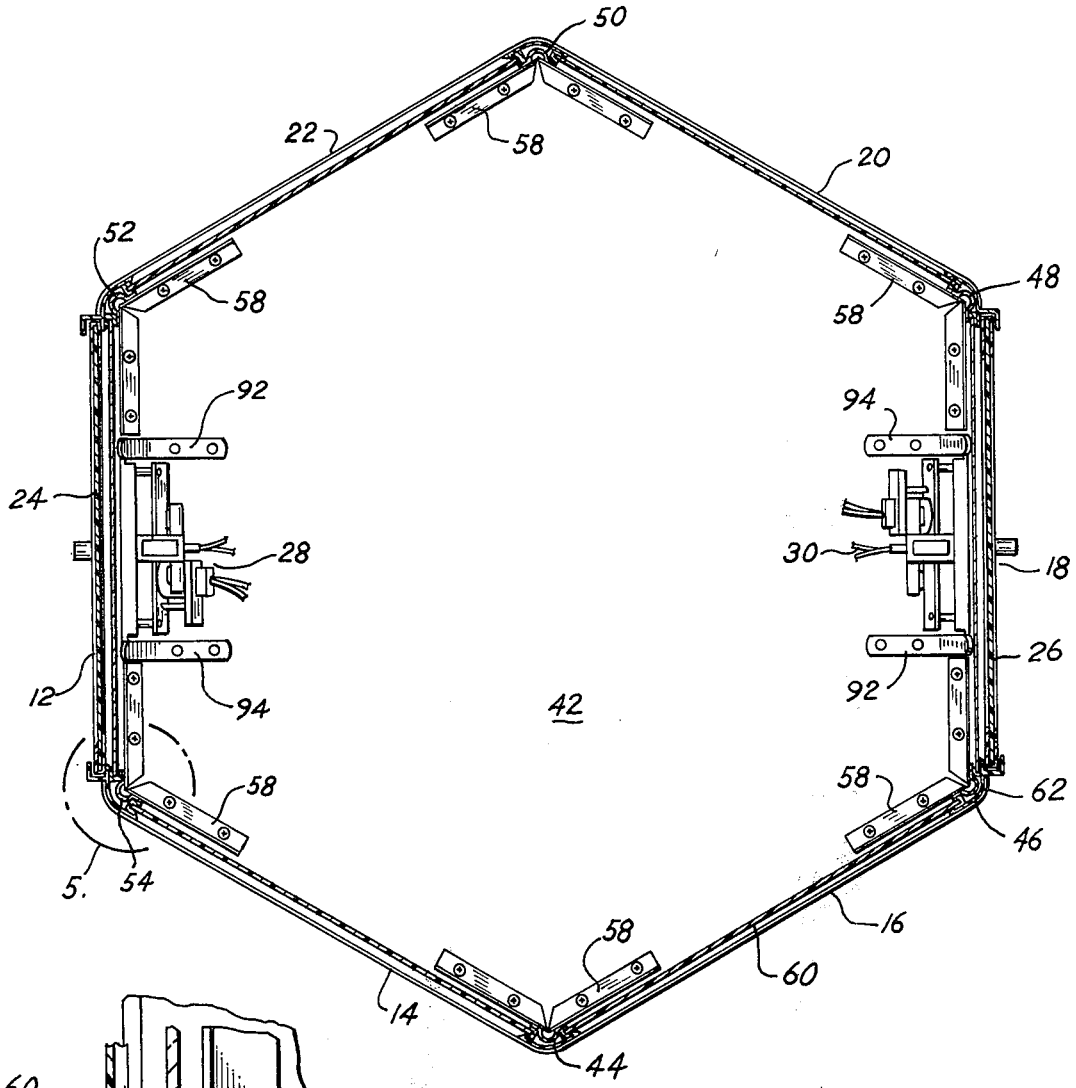
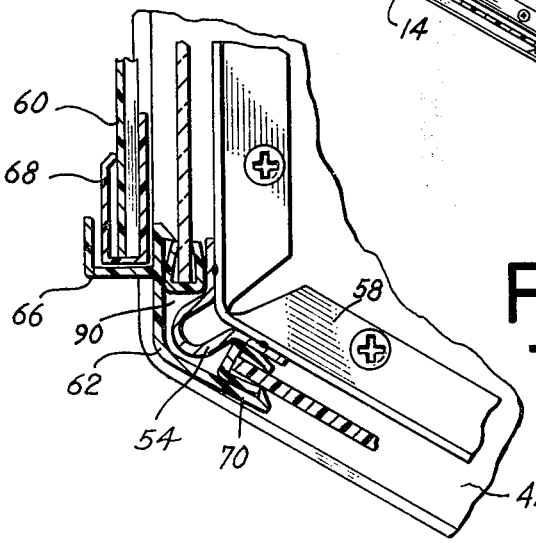
Fig. 5

ROTATING MESSAGE DEVICE

Signs and other informational devices are often placed in restaurants, lounges, bars and similar establishments where the customers are seated at tables, in booths or at bars, and remain in one place for extended periods of time. Wall or counter signs often cannot easily be seen or readily noticed by the patron, and the wall, counter or shelf spaces for signs and the like are frequently relatively limited, sometimes resulting in crowding and inappropriate placing and spacing of the signs, detracting from the decor of the establishment. Further, stationary signs on a wall or shelf attract little attention and are not likely to be read. It is therefore one of the principal objects of the present invention to provide a message displaying device or mechanism which gives maximum exposure to the messages contained thereon and which efficiently utilizes the space available for messages, such as advertising signs, time of day and menus.

Another object of the invention is to provide a rotating message device which can easily be suspended from a ceiling, beam, wires, cable or other overhead structure, and which can conveniently be placed where most patrons or customers can see the messages on the device as it is being rotated.

Still another object of the invention is to provide a versatile rotating message device which is relatively simple in construction and operation, and which can be installed and removed as a package without the use of special tools or equipment.

A further object is to provide a rotating sign or message board which provides a substantial amount of advertising space in a relatively compact structure, and which is easily handled and economically operated over long periods of time without servicing.

Another object is to provide a rotating sign of the aforementioned type which is so constructed and designed that the messages or signs can be easily and readily changed, and which provides a variety of different types of message presentation capabilities without changing the basic design or structure of the device.

Additional objects and advantages of the present invention will become apparent from the following description and accompanying drawings, wherein:

FIG. 4 is a horizontal cross sectional view through the device shown in the preceding figures, the section being taken on line 4 — 4 of FIG. 3; and FIG. 5 is an enlarged framentary, horizontal cross sectional view, the sectional view being identified in FIG. 4 by the circle 5.

Referring more specifically to the drawings, numeral 10 indicates generally the present rotating message device, the one shown being hexagonal in shape, with the various sides indicated by numerals 12, 14, 16, 18, 20 and 22 containing different types of messages or advertising signs, menus and the like with different information. Menu boards 24 and 26 can be used for different types of messages, and are duplicates of one another in structure. The signs on the other sides are preferably of a type which permits an internal light of the device to shine through and illuminate the letters or numerals in the sign or other message. A clock, such as a digital clock, is shown at numerals 28 and 30 beneath menu boards 24 and 26, respectively; however, signs or other information may be used in place of the clocks.

Figure 1:
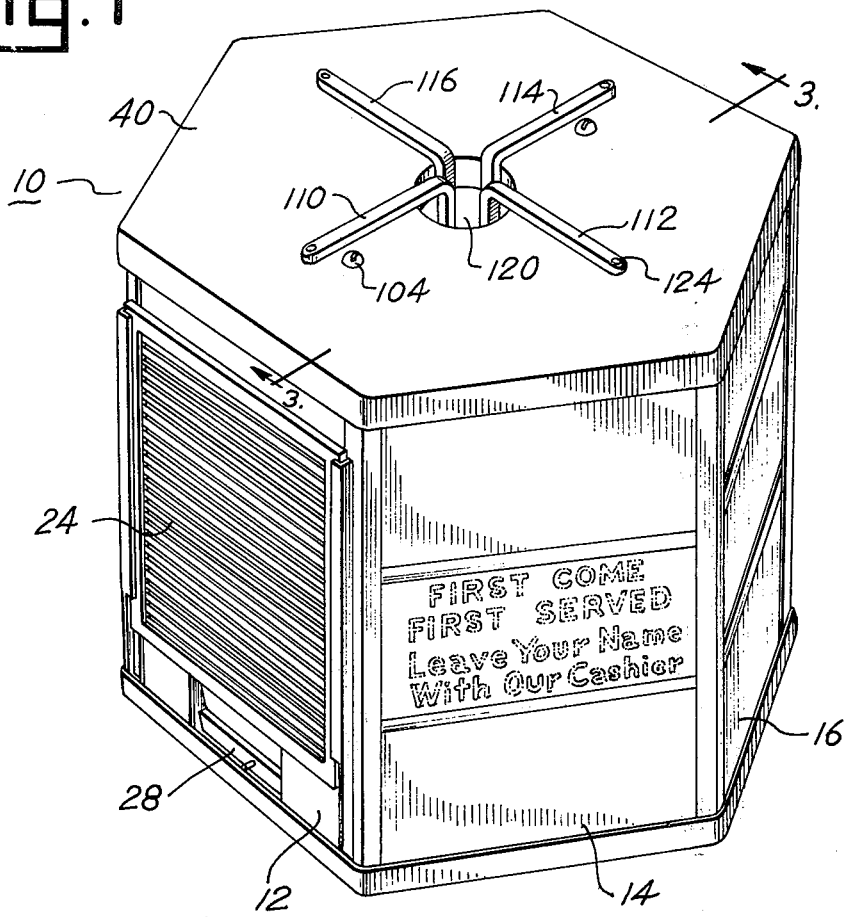
FIG. 1 is a perspective view of a rotating message device embodying the present invention.
Figure 2:
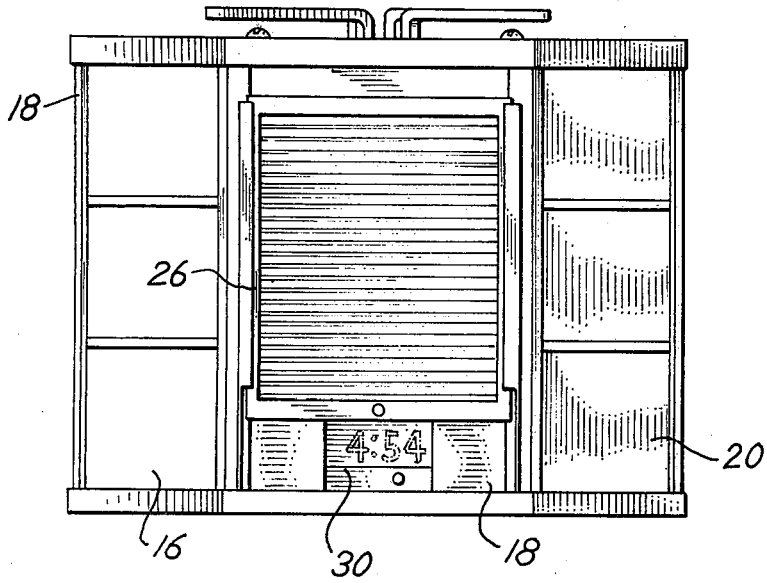
FIG. 2 is an elevational view of the side of the present rotating message device opposite that shown in FIG. 1.
Figure 3:
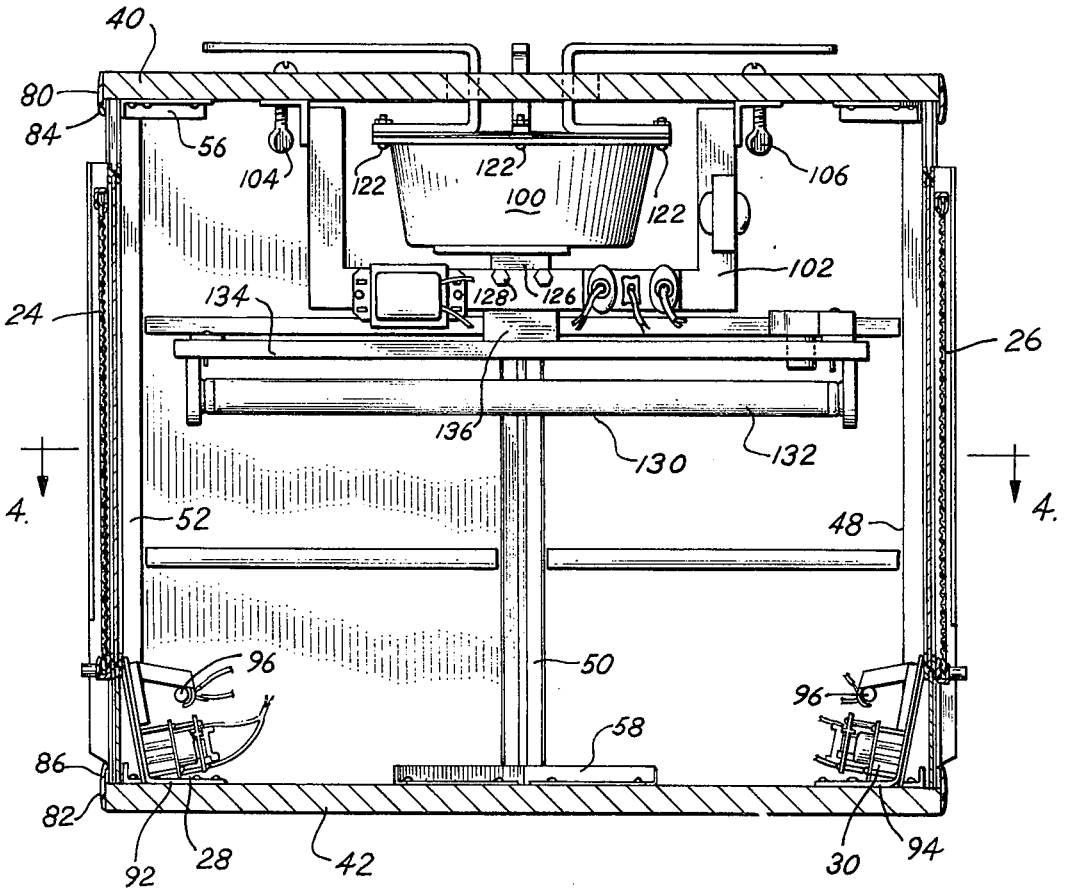
FIG. 3 is a vertical cross sectional view of the rotating message device shown in the preceding figures, the section being taken on line 3 — 3 of FIG. 1.

The structure of the device is best illustrated in FIGS. 3, 4 and 5, and consists of upper plate 40 and a lower plate 42, the two plates being connected to one another by vertical posts 44, 46, 48, 50, 52 and 54, each post consisting of a modified angular metal member connected at its upper end to the underside of the plate by bracket 56 and to the upperside of lower plate 42 by bracket 58, screws being shown as the means for securing the brackets to the respective plates. The upper and lower plates, which may be of pressed wood or other suitable material, and the six vertical posts secured by the brackets to their respective plates, form a rigid structure.

The signs are normally transparent panels such as plastic, which permit the internal light to shine therethrough, and are held in place between their respective posts, such as the panel 60 disposed between posts 44 and 46, by strips 62, the strips preferably being of slightly flexible plastic material to permit them to be easily assembled in the basic structure as the panel is inserted. The strip 62 may be provided on one side with a U-shaped flange 66 for receiving the menu type plate in panels 12 and 18 and with a lateral flange 70 on the opposite side; however, as an alternative, strip 62 has two lateral flanges 70. Peripheral strips 80 and 82 extend around plates 40 and 42 and project beyond the inner surface of the respective plate, forming a downwardly extending flange 84 and an upwardly extending flange 86 for retaining the upper and lower ends of vertical strips 62 in front of the vertical posts 44, 46, 48, 50, 52 and 54. Since the vertical strips and posts are angular in shape, the strips stay in proper position along the external surface of the posts, and are held firmly in place by the adjacent plates.

U-shaped flange 66 provides a slot which extends outwardly beyond the periphery of the upper plate so that the menu panels can easily be slipped into position from the top or bottom. A lower or frame member holds the menu panel in proper vertical position. The panels of the type shown on sides 14 and 16 are held in place by flanges 70 of strips 62 and may be of any number of different materials such as plastic, cardboard or metal. These panels are inserted by pulling flange 70 outwardly and inserting the edge of the panel in the slot 90 formed by flange 70 and the outer surface of the respective vertical post.

The clocks 28 and 30, which may be considered conventional for the present description, are held in place by brackets 92 and 94 secured by screws to the upper surface of lower plate 42. A light, such as that shown at numeral 96, may be included to illuminate the clock; however, the clocks may be of different types which do not require an external illumination such as that illustrated. The panels of the type shown at numeral 14 may actually consist of two or more sections held together on their horizontal edges by H-shaped plastic or metal strips, and one or more of the panels may be opaque and the other panel may be transparent. However, messages may be on all of the individual panel sections, and when assembled, are inserted in the space between two vertical posts and strips 62, in the same manner as a single panel, as previously described herein.

The overall structure is rotated by motor 100 mounted in the inner space of the device in and on a U-shaped bracket 102 which is secured to the underside of the upper plate by screws 104 and 106 extending into or through the plate. The motor, which may be considered conventional for the purpose of the present invention, is held in fixed position with respect to the supporting structure for the unit by four arms 110, 112, 114 and 116 extending laterally in spaced relation to the upper surface of plate 40 and then downwardly through a center opening 120 in the plate, and rigidly secured to the upper part of the motor by a purality of bolts or screws 122. The outer ends of the arms are provided with one or more holes 124 for securing the arm, and thus for securing the device, to the supporting structure such as a beam or ceiling member. The lower side of the motor is secured to bracket 102 by a fixture 126 and bolts 128, the fixture being connected to the shaft of the motor so that bracket 102, along with the remainder of the outer structure consisting of plates 40 and 42 and the interconnecting posts, rotates as the motor is driven, the motor remaining stationary with respect to the supporting structure.

A light 130 is mounted on the underside of bracket 102, the one shown being a fluorescent type having a tube 132 and a fixture 134 connected to bracket 102 by a member 136. The transformer and electrical connections are shown schematically; however, they are conventional and may be varied to suit requirements. A different type of lighting system may be used if desired, the one shown giving effective lighting to all six panels substantially uniformly.

In the operation of the present rotating message device, the arms 110, 112, 114 and 116 are secured to a supportng structure such as a ceiling joist or beam, or they may be connected to wires or chains which, in turn, are connected to one or more supporting structures, thus suspending the device over-head in a position where the device can be seen from all directions. The height at which the device is suspended may be varied to satisfy the requirements of the particular establishment in which it is installed. After the unit has been installed with the desired messages and the power turned on, the outer housing structure is rotated by motor 100, which is held stationary in the internal space of the device. The motor has a gear reduction unit contained therein; thus, the output of the motor is relatively slow so that the rotation of the device is likewise relatively slow, permitting the signs, menu and other messages or indicia on the various panels to be easily read as the unit rotates. When the unit has been stopped, the sign section and menu boards may be readily changed, the menu boards being merely inserted in grooves provided by flanges 66 along the opposite edges of the particular side, such as sides 12 and 18. The clocks remain fixed and are continuously in operation regardless of whether the unit is rotating or not. The other panels may be changed from time to time by lifting the flexible flange 70 of strip 62 to permit the removal of the vertical edges of the panels from, and their insertion in, slot 90 formed between strip 62 and the adjacent post.

While six sides are shown, a different number of sides may be used in some installations. Other changes and modifications may be made in the message board device without departing from the scope of the invention.

I claim:

1. A rotating message device comprising a horizontally positioned upper plate, a horizontally positioned lower plate spaced from said upper plate, posts interconnecting said plates and being spaced from one another around the periphery of said plates, message panels disposed in the space between said posts and being supported along the panel sides and, with the top and bottom plates, forming a rigid body with an enclosed interior space, a motor disposed in said interior space for rotating said body, a bracket attached to said upper plate for supporting said motor in said space an arm means connected to said motor and projecting upwardly therefrom through a center hole in said upper plate for connecting said device to a plurality of spaced points on a supporting structure and thereby supporting said device in operating position, and removable, flexible strips paralleling said posts and disposed on the outside thereof and extending from one panel space to the next panel space for holding the panels in place adjacent said posts.

2. A rotating message device as defined in Claim 1 in which a light means is disposed in said interior space and one or more of said message panels are, at least partially, transparent.

3. A rotating message device as defined in Claim 1 in which a light fixture is disposed in said interior space and a means supports said light fixture on said motor support bracket.

4. A rotating message device as defined in claim 1 in which vertical flanges are provided on two adjacent strips to form facing vertical slots and a menu board is slidably disposed in said slots.

5. A rotating message device as defined in Claim 1 in which said posts are so spaced that they define six vertical sides on said body for receiving said message panels.

* * * * *